United States Patent [19]

Strohmeyer, Jr.

[11] Patent Number: 4,505,209

[45] **Date of Patent: * Mar. 19, 1985**

[54] UNFIRED DRYING AND SORTING APPARATUS FOR PREPARATION OF SOLID FUEL

[75] Inventor: Charles Strohmeyer, Jr., Gladwyne, Pa.

[73] Assignee: Electrodyne Research Corporation, Gladwyne, Pa.

[ * ] Notice: The portion of the term of this patent subsequent to May 22, 2001 has been disclaimed.

[21] Appl. No.: 595,518

[22] Filed: Mar. 30, 1984

Related U.S. Application Data

[63] Continuation-in-part of Ser. No. 464,062, Feb. 3, 1983, Pat. No. 4,449,483.

[51] Int. Cl.[3] ..... F23D 19/02

[52] U.S. Cl. ..... 110/245; 122/4 D

[58] Field of Search ..... 110/245; 432/15, 58; 431/170; 122/4 D

[56] References Cited

U.S. PATENT DOCUMENTS

| | | | |
|---|---|---|---|
| 2,803,439 | 8/1957 | Fikenscher | 122/1 A |
| 3,605,655 | 9/1971 | Warshawsky et al. | 122/4 D |
| 4,273,073 | 6/1981 | Robinson | 122/4 D |
| 4,329,324 | 5/1982 | Jones | 423/244 |
| 4,349,969 | 9/1982 | Stewart et al. | 122/4 D |
| 4,434,723 | 3/1984 | Brealey et al. | 122/4 D |
| 4,442,796 | 4/1984 | Strohmeyer | 122/4 D |
| 4,449,483 | 5/1984 | Strohmeyer | 122/4 D |
| 4,452,180 | 6/1984 | Hassan | 122/1 A |

*Primary Examiner*—Henry C. Yuen

*Attorney, Agent, or Firm*—William J. Ruano

[57] ABSTRACT

The invention comprising a drying and sorting apparatus for preparation of solid fuel prior to firing in a combustion furnace. Unsaturated air/gas is passed through a bed containing a mixture of solid fuel and inert material particles, fluidizing them. The unsaturated air/gas is the drying vehicle. When in a fluidized state, the lighter organically derived solid fuel particles separate from the heavier inert material particles. The air/gas is admitted to the bed directionally in a manner which drives the mixture in a retraceable path to outlet points downstream of the point of feedstock entry, the heavier inert material settling at the bottom and the lighter solid fuel particles rising in the bed. Means are provided in the sorter floor for selectively concentrating and directing the solid inert material to the collection point transversely to the direction of particle flotation.

4 Claims, 5 Drawing Figures

UNFIRED DRYING AND SORTING APPARATUS FOR PREPARATION OF SOLID FUEL

Figure 1:
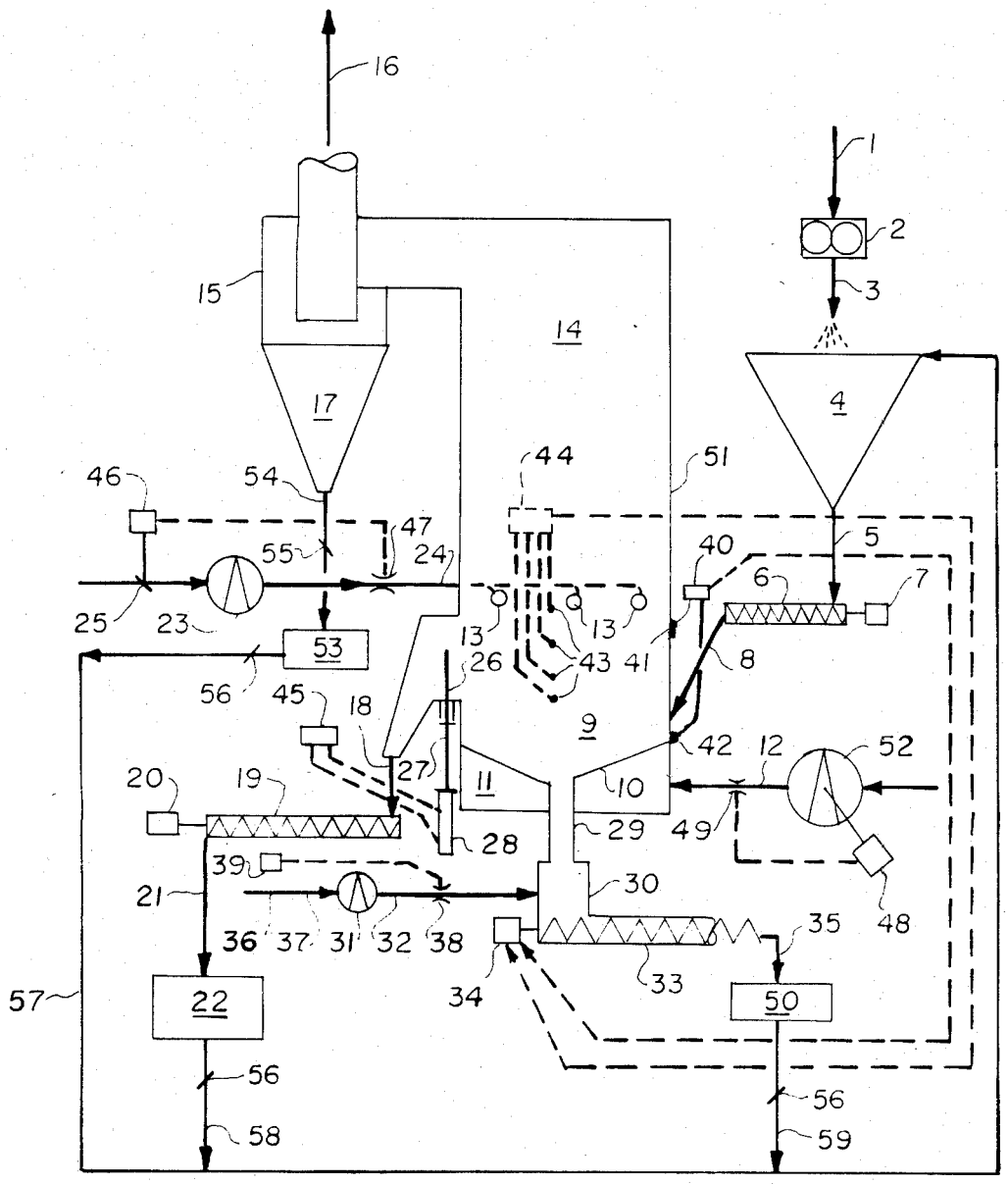
Figure 2A:
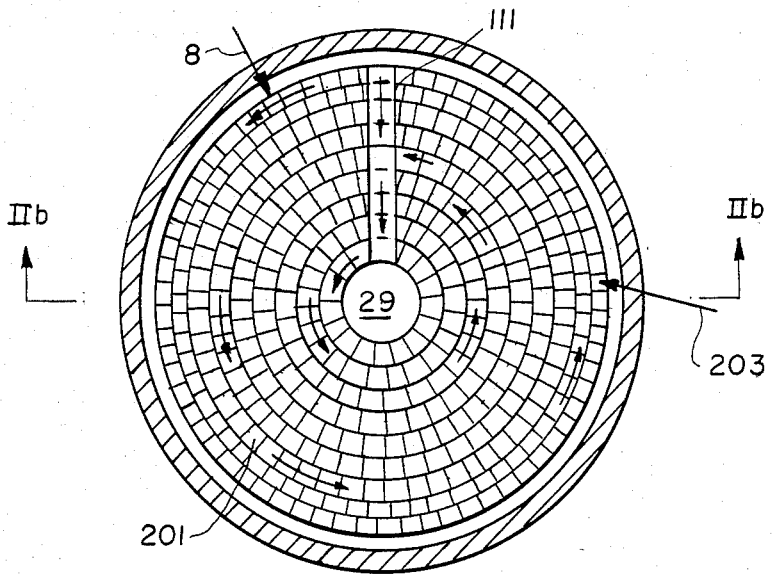
Figure 2B:
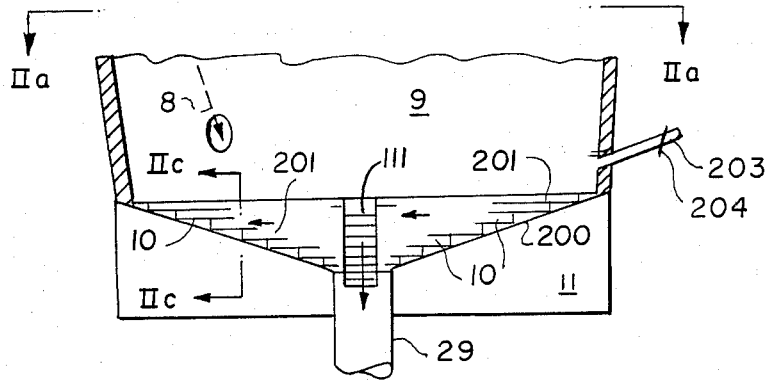
Figure 2C:
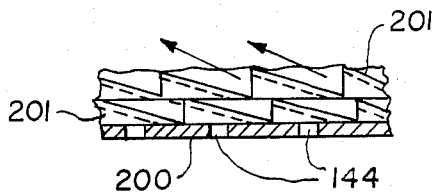
Figure 2D:
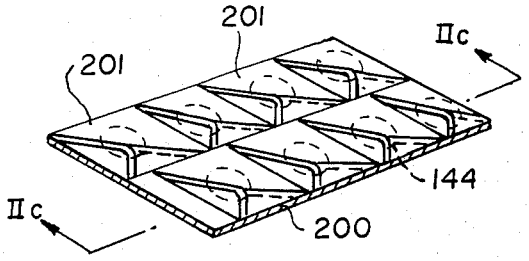

This invention is a continuation-in-part of U.S. patent application Ser. No. 06/464,062 filed 02/03/83 now U.S. Pat. No. 4,449,483 and is a variation thereupon.

This invention relates to improved means for utilization of solid waste fuel or culms by upgrading of the fuel prior to combustion in a conventional steam generator. Upgrading is accomplished in an unfired drying and sorting apparatus which separates the solid fuel from the inert material as well as removes moisture from the mixture. Separation is accomplished through fluidizing particles of solid fuel and inert materials in a stream of unsaturated air/gas. The denser inert material particles settle to the lower portion of the fluidized bed and the less dense fuel particles rise to the upper portion of the bed.

In the present invention the fluidized bed is of the unfired type and is used for sorting purposes to separate the more dense particles from the less dense particles. The construction of the bed floor is designed in accordance with migrating principles for movement of bed materials in a retraceable path as previously disclosed. Bed migration is used to create a retention period in the transport of low grade solid fuel and inert materials from a common point of injection into the bed to separate points of removal. Admission of unsaturated air/gas to the bed in a directional and distributed manner establishes the transport route.

Sorting of active fuels from waste inert material has in the past been mainly associated with processes incorporating water washing and floatation in water. Use of water for separation of of solid fuel from inert solid materials creates environmental problems as large quantities of water are involved which are dumped into waste disposal areas for settlement of the fine solid particles. The water becomes acidic.

The present invention contains the active fuel and waste material feedstock to the original constituants without dilution effects through dispersion in the surrounding environment.

It is desirable to reduce the moisture in the coal culms through a drying process while removing the inert solids.

The density of common solid materials which are associated with culms are:

| Material | Weight, lb/cu. ft. |
|---|---|
| Iron | 443 |
| Slate | 175 |
| Stone/gravel | 100–175 |
| Anthracite Coal (Sized) | 50–60 |
| Sand | 90–106 |
| Wood | 35–50 |
| Range of organic materials suitable for fuel | 30–70 |

An unfired fluidized bed process is suitable for drying and sorting solid waste culms. Unsaturated air or gas is introduced below the bed to suspend it and tumble the solid materials so that they come into contact with unsaturated air/gas.

In the fluidizing and drying process, the more dense particles settle to the bottom of the bed. The solid feedstock can be run through a crusher or equivalent for rough sizing purposes. The sorting and drying operation can be sequential in that the first pass segregates the particles by sizing and the second pass sorts the particles for density. The bed support plate and fluidizing gas admission port design causes the fluidized bed to migrate over the floor in a retraceable path.

The floor construction shown offers no resistance to the movement of particles. The heavier particles are removed at a collection point within the fluidized bed after a period of time during which separation from the fuel takes place.

For the apparatus and systems described herein, a specific object of this invention is to provide a means for separation of solid fuel and inert material utilizing unfired fluidized bed principles.

A further object is to dry said solid fuel during the separation process.

A still further object is to provide a means to separate and collect solid fuel entrained in the air/gas stream used for fluidizing the bed at a location downstream of the bed.

A still further object is to provide a means to remove inert material from the fluidized bed bottom by means of a vertical conduit through which the inert material flows downward opposed by an upflow of air/gas which limits the downflow of solid materials to heavier more dense particulate.

A still further object is to control solids density or the ratio of inert material to fuel from top to bottom of the bed.

A still further object is to selectively control the level of the upper boundary layer of significant solids in the fluidized bed.

A still further object is to control the elevation of point of removal of solid fuel particles from the fluidized bed.

A still further object is to provide a means for skimming fine fuel particles from the upper boundary layer of the fluidized bed for entrainment in the air/gas stream exiting from the bed.

A still further object is to selectively recycle collected solid material from any collecting point to the bed as feedstock, and A still further object is to provide a means for sequence processing of the feedstock of solid particles of fuel and inert material, first passage through the system intended for sorting larger particles from the smaller particles and second passage of like sized particles through the same or similar apparatus intended for density sorting.

The invention will be described in detail with reference to the accompanying drawings wherein:

FIG. 1 is a sectional diagramatic arrangement of the unfired drying and sorting apparatus.

FIGS. *2a–2d* are details of the floor for the fluidized bed.

On FIG. 1, solid materials, after initial sort (removal of magnetic iron and other large pieces as timber), are fed through conduit 1 at a controlled rate to crusher 2 which reduces particle size to a value as ⅜" and below.

Crusher 2 discharges through conduit 3 to surge hopper 4. Raw feedstock in hopper 4 flows through conduit 5 to screw feeder 6. Variable speed drive 7 controls rate of feedstock flow through conduit 8 to fluidized bed 9 in dryer/separator 51. Floor 10 has directional slots for admission of unsaturated air/gas to bed 9 from plenum 11. The floor construction is discussed in detail below. Unsaturated air/gas enters plenum 11 through conduit 12. Secondary air/gas may be admitted through ports 13 above bed 9 for skimming fine solids from the top of bed 9, entraining them in the outlet air/gas stream.

Blower 52, powered by a variable speed drive 48, furnishes air/gas to conduit 12 at a controlled preset flow rate and as measured by flow meter controller 49 in conduit 12.

Blower 23 supplies air/gas to ports 13 through conduit 24. Flow regulator 25 controls air/gas rate of flow to ports 13 to a preset value. Regulator 25 is powered by control drive/controller 46 which receives a signal from flow meter 47 to determine proper setting for correction of error.

Ports 13 are optional.

Air/gas from bed 9 and ports 13 flows up through plenum 14 and through cyclone separator 15 to exhaust conduit 16. A bag house (not shown) may be incorporated in conduit 16 for complete removal of dust from the air/gas stream.

The air/gas stream may be heated before being discharged into plenum 11. The heating process may be incorporated with a steam generator air/gas system or other combustion apparatus. Such feature is not part of this invention. Temperature exiting from plenum 14 should be limited to a maximum of 325° F. Heating of the air/gas will accelerate the drying process as the water retention capacity of the air/gas increases.

Solid material separated in cyclone 15 fall down into hopper 17.

Solid materials entering bed 9 through conduit 8 are suspended in the bed by air flow through slotted directional openings in floor 10. The turbulance in the bed 9 dries the solid particles as the particles contact the unsaturated air/gas.

The dry solid fuel material rises in bed 9 and overflows through conduit 18 to screw conveyor 19 driven by variable speed drive 20 for control of rate of flow. Conveyor 19 discharges through conduit 21 to storage means 22.

Gate 26 regulates the level of overflow of solids from bed 9 to conduit 18. The height of gate 26 is variable and guides are provided in the gate housing. Gate 26 may be dropped through a slot in the housing. The gate is positioned by stem 27 which is actuated by power piston 28 to maintain a preset elevation for gate 26.

Heavier inert non-combustable solid materials separated and collected in fluidized bed 9 are drawn to conduit 29 where they fall to chamber 30. Air/gas is discharged by blower 31 through conduit 32 to maintain a pressure and upward gas flow in conduit 29 which suspends the lighter particles in bed 9. Only the heavier particles fall through conduit 29 to chamber 30.

Flow regulator 36 in conjunction with power actuator/controller 39 and flow meter 38 provide selective control of rate of air/gas flow through conduit 29 to a preset value for purposes of controlling material density which passes down through conduit 29.

Solids collected in chamber 30 are removed through screw conveyor 33 driven by variable speed drive 34 which controls flow rate of solid particles which are discharged through conduit 35 to collection and removal point 50.

Dryer separator 51 acts as an unfired fluidized bed receiving unsaturated fluidizing gases through conduit 12, solid material containing fuel through conduit 8 and overflowing sorted fuel through conduit 18. The overflow level above floor 10 may be controller by gate 26. Solid bed materials carried along with the air/gas are separated in cyclone 15.

FIG. 2 is a detail of dryer separator 51 floor 10. Floor 10 consists of support plate 200. Sized holes 144 are drilled in support plate 200 in a multiple concentric ring arrangement. Holes 144 are sized to pass sufficient air/gas to all portions of floor 10 to maintain uniform fluidizing and drying throughout the bed.

Covers 201 are segmented to form a circular pattern when laid side by side as drawn on FIG. 2. Covers 201 are centered over holes 144. Covers 201 are formed so that when attached over holes 144, three sides of covers 201 are flush with support plate 200 and the fourth side provides a slotted opening between support plate 200 and cover plate 201.

Air/gas exiting through the slotted openings discharges tangentially to the concentric rings of covers 201. The direction of air gas flow is indicated by the directional arrows on FIG. 2.

The top of covers 201 do not restrict particle movement in the direction of air flow. The heavier particles entering fluidized bed 9 through conduit 8 fall to floor 10 and are swept along with the air flow.

The air/gas which is admitted directionally causes the bed to migrate when fluidized. The pattern on FIG. 2 is circular in motion. Other patterns could be used with the same results.

As the bed circulates, the lighter less dense materials rise in the bed and the material dries as it tumbles in the unsaturated air/gas stream. Some of the material may leave the bed entrained in the air/gas stream but will be caught in cyclone 15.

After at least one revolution through bed 9, the heavier particles as slate and stones moving along the floor 10 over covers 201 are trapped in trough 111, the floor of which is several inches below the plane of floor 10. The trough 111 is provided with sides. The floor of trough 111 is similar to the remainder of floor 10, except the covers 201 over holes 144 discharge air/gas toward the center of the bed and conduit 29 as shown on FIG. *2a*. The heavy particles are removed through conduit 29 as described above.

Lances 203 are located in the side of bed 9. One lance 203 is shown. Others can be installed at say 60 degree angular segments. They admit air or steam under pressure on occasion to sweep the floor 10 clean or to initiate bed fluidization. Control means 204 regulates air or steam admission to the individual lances.

Means for controlling operation of the apparatus described above are discussed below:

The quality of the feedstock can vary widely. Such variation tends to be averaged by the storage capacity within the bed. This smooths the regulation process and the retention time enables effective control of the unit.

Differential pressure across bed 9 is an effective measure of determining the quality of the materials in the bed. Differential pressure through a bed of fixed depth is a measure of the density of the materials in the bed. The higher the pressure drop for similar sized particles, the greater will be the density and vice versa.

Since the heavier particles settle to the bottom of the fluidized bed, differential pressure increase indicates a buildup of inert material at bed 9 bottom requiring a faster rate of removal of such particles through conduit 29 and vice versa.

Pressures in the upper and lower portions of bed 9 are measured at points 41 and 42 respectively in differential pressure measuring device 40. The output of 40 is sent to variable speed drive/controller 34 where indication of an increasing pressure above a set value increases the speed of the drive component of 34 and vice versa.

The set point for drive/controller 34 is determined through empirical means by observing, testing and optimization of the processing results obtained from use of the apparatus when handling various materials. The control means levelize performance after standards have been set.

It is important to be able to detect level of bed 9 upper boundary layer having at least a significant density on the low end of the bed density scale compared with solids density in the air/gas above the upper boundary layer in plenum 14.

To accomplish such objective material density in vessel chamber 51 is measured at points 43 which are spaced vertically in chamber 51. Each of points 43 connects to measurement device 44 through a conduit. Device 44 is equipped with means to determine density differential between points 43. Such means incorporates a high velocity metered air jet which is injected into chamber 51 horizontally at each of points 43. The difference in particulate density at the various elecations associated with points 43 creates a back pressure in the metered air supply conduit connecting device 44 with the individual points 43. Device 44 senses the differential pressure and differential pressure is calibrated to indicate a measure of particulate density in the gas stream rising through vessel chamber 51.

High level indicates that flow of solids through conduit 18 and 29 is insufficient. Device 44 is optionally connected to drive/controller 34 to increase speed of screw conveyor 33 on a high level in bed 9 to accelerate rate of removal of solids from chamber 30 and vice versa. Such increase can be accomplished through biasing/ratioing of the bed pressure differential set point.

Set point for actuator controller 39 for positioning regulator 36 is adjusted to maintain adaquate flow of solids to conveyor 33 for removal through screw conveyor 33 and conduit 35.

Screw conveyor 19 is operated at a speed to remove particulate which spills over gate 26 uniformly into conduit 18. Conveyor 19 is not intended to handle surges in flow which may develop. Thus, a buildup of level in bed 9 may occur and would be handled as described above. Manual adjustments of conveyor 19 speed to produce a desire rate of flow of separated materials can be developed from working experience with specific mixtures of solid feedstock from hopper 4.

Elevation of the overflow level associated with gate 26 may be adjusted to compensate for varying mixes of fuel and inert solid materials. The gate 26 overflow level may be raised where particulate density in bed 9 is in the low range to increase retention time for separation purposes and vice versa. The level can be set to produce optimum results determined from working situations pertaining to sizing and uniformity of the feedstock as well as to the ratio of the lighter combustible solids to heavier inert materials.

Ports 13 can be slanted slightly downward from a horizontal plane into bed 9 to skim fine solid materials from the upper boundary of bed 9 and to entrain such materials in the air/gas stream passing to separator 15. The sort of fine fuel from fine inert material is difficult when mixed with substantially larger particles. Separation of fines during the initial processing operation permits reprocessing of the fines as a separate class of material during a subsequent passage of the fines through the same or similar type of apparatus.

FIG. 1 illustrates individual points of collection 22, 50 and 53 for the sorted inert material from conduit 35, the sorted solid fuel from conduit 18 and the separated fines from hopper 17 respectively. The fines flow through conduit 54 and gate 55 from hopper 17 to storage bin 53. Each of bins 22, 50 and 53 has substantial capacity. Pneumatic or other means (not shown) may be utilized for conveying materials through conduits 21, 35 and 54.

Means are provided to return the material individually from any of bins 22, 50 and 53 to hopper 4 for reprocessing of a like sized grade of material. This enhances separation of solid fuel from solid inert material. Gates 56 isolate the individual bins 22, 50 and 53.

Conduits 57, 58 and 59 connect individual bins 53, 22 and 50 to hopper 4 respectively.

Pneumatic or other means (not shown) may be used for conveyance through conduits 57, 58 and 59.

The conduits 57, 58 and 59 may alternatively feed to similar processing apparatus to that illustrated on FIG. 1 for completion of a two step processing application, the first step sorting materials primarily by size and the second step sorting materials for density into concentrated solid fuel and inert material.

Thus, it will be seen that I have provided an efficient embodiment of my invention whereby means are provided for separation of solid fuel from inert material and drying the solid fuel utilizing an unfired fluidized bed apparatus, for collection of solids which are entrained in the gas discharge from the bed, for air/gas discharge from the bed, for control of average solids density from top to bottom of the bed, for control of the level of of the bed upper boundary layer, for control of the elevation of the point of removal of solid fuel from the bed, for skimming fine solid particles from the boundary layer, and for recycling fine solids, solid fuel and inert material individually and selectively in the same or similar apparatus.

While I have illustrated and described several embodiments of my invention, these are by way of illustration only and various changes and modifications may be made within the contemplation of my invention and within the scope of the following claims:

I claim:

1. An unfired drying and sorting apparatus for preparation of solid fuel prior to firing in a combustion furnace incorporating:

a supply of sized moisture bearing solid fuel and inert material to be dried and sorted;

a vertical chamber;

a fluidized bed comprising a mixture of said sized particles of said solid fuel and inert material;

means for continuously adding a stream of said sized particles to said bed for drying and sorting;

a sorter at the base of said vertical chamber having a floor for supporting said fluidized bed within said vertical chamber;

ports in said floor;

means continuously furnishing unsaturated air/gas to said ports;

said ports adapted to discharge said unsaturated air/gas into said bed directionally and in a distributed pattern over said sorter floor fluidizing said mixture of sized particles of solid fuel and inert material and driving said mixture in a retraceable path around said floor of said bed, said unsaturated air/gas upflow through said bed vaporizing moisture borne by said particles and transporting said vapor in said air/gas stream exiting from said bed;

means for removal of said inert particles from said bed through a first collection point including a trough-like depression in said bed floor wherein means are provided for directing a portion of said directional fluidizing air toward said first collection point at the bottom of said trough and adapted for transporting a heavier/more dense non-combustible portion of said solid material through said trough in a direction transverse to the general direction of particle flotation above said trough and toward said first collection point;

said trough-like depression being located downstream of the point where said moisture bearing sized solid particles are introduced to said bed;

means for segregating said solids directed to said first collection point adapted to pass said heavier/more dense solid materials through said first collection point and to reject lighter/less dense fuel portions of said particles to said bed upper portion;

a second collection point at said upper portion of said bed adapted for removing said lighter/less dense combustible portion of said solid material from said vertical chamber;

said means for adding a continuous supply of said sized particles to said bed and said first and second collection points being located with reference to said retraceable path in a manner to provide retention time for said particles in said bed and to cause particles from said point of entry to said bed in a fluidized state to flow to said second or third collection points selectively by virtue of particle density and over a period of time to facilitate sorting;

means located at the outlet of said vertical chamber for removal of air/gas and water vapor;

means connected to said outlet means adapted to separate solid particles entrained in said air/gas and water vapor stream; means for measurement of differential pressures across said bed at various elevations and adapted to determine bed height; and means for injecting secondary air horizontally at the top elevation of said bed at varying elevations and adapted for selectively skimming fine solids from said top of said bed, entraining said fines in said outlet air/gas stream.

2. An apparatus as defined in claim 1 and including:

means for measuring differential pressure across said bed for a given bed depth and adapted for adjustment of removal rate of said heavier/more dense solid material through said first collection point, an increase in differential pressure requiring an increase in removal rate and vice-versa.

3. An apparatus as defined in claim 1 and including;

means for raising or lowering said bed overflow level in response to quality of material to be processed, raising level to accomodate lower density solid materials processed and vice-versa.

4. An apparatus as defined in claim 1 and including:

a means for collecting and sorting said solid particles withdrawn from any of said first or second collection points; and means for recycling said stored withdrawn solid particles as a batch to said bed as a continuous supply of solid particles to said bed for classification of said solids by density through said first and said second collection points.

* * * * *